US010076003B2

(12) United States Patent
Reischmann et al.

(10) Patent No.: US 10,076,003 B2
(45) Date of Patent: Sep. 11, 2018

(54) INDUCTION COOKING APPLIANCE

(71) Applicants: Michael Reischmann, Eustis, FL (US); Phillip Williams, Clinton, CT (US); Ed Gilchrest, Oxford, CT (US); Joseph LeRoy Lehman, Simsbury, CT (US)

(72) Inventors: Michael Reischmann, Eustis, FL (US); Phillip Williams, Clinton, CT (US); Ed Gilchrest, Oxford, CT (US); Joseph LeRoy Lehman, Simsbury, CT (US)

(73) Assignee: Kenyon International, Inc., Clinton, CT (US)

( * ) Notice: Subject to any disclaimer, the term of this patent is extended or adjusted under 35 U.S.C. 154(b) by 41 days.

(21) Appl. No.: 14/847,637

(22) Filed: Sep. 8, 2015

(65) Prior Publication Data

US 2016/0073451 A1 Mar. 10, 2016

Related U.S. Application Data

(60) Provisional application No. 62/046,664, filed on Sep. 5, 2014.

(51) Int. Cl.
*H05B 6/06* (2006.01)
*H05B 6/12* (2006.01)

(52) U.S. Cl.
CPC ..... *H05B 6/062* (2013.01)

(58) Field of Classification Search
CPC ..... H05B 6/06; H05B 6/12
(Continued)

(56) References Cited

U.S. PATENT DOCUMENTS 3,710,062 A 1/1973 Peters, Jr.
3,742,175 A 6/1973 Harnden, Jr.
(Continued)

FOREIGN PATENT DOCUMENTS

EP 0675671 A2 10/1995
JP H0992447 A 4/1997
(Continued)

OTHER PUBLICATIONS

Sweeney, Micah, et al. (2014) Induction Cooking Technology Design and Assessment. Electric Power Research Institute (EPRI). Summer Study on Energy Efficiency in Buildings. pp. 9-370-9-379.
(Continued)

*Primary Examiner* — Quang Van
(74) *Attorney, Agent, or Firm* — St. Onge Steward Johnston & Reens, LLC

(57) ABSTRACT

A system for operation of an induction stove includes an AC to DC voltage converter receiving AC voltage from a power input, a voltage sensing unit coupled to the converter and including an optocoupler, and a processor coupled to the sensing unit for receiving voltage information from the unit and controlling at least one of input voltage, input current, and oscillation frequency of a heating coil of the induction stove. A method for operating an induction stove includes converting an AC voltage from a power input to a DC voltage, supplying the DC voltage to a voltage sensing unit coupled to the converter and including an optocoupler, transmitting a voltage measurement from the sensing unit to a processor, and controlling at least one of an input voltage and oscillation frequency to a heating coil of the induction stove via the processor based at least in part on the voltage measurement.

25 Claims, 9 Drawing Sheets

(58) Field of Classification Search
USPC ..... 219/620, 622, 626, 618, 625, 627, 677, 219/664, 667, 660, 661, 662, 663; 363/37; 399/33; 307/104; 320/108, 137
See application file for complete search history.

(56) References Cited

U.S. PATENT DOCUMENTS

| | | | |
|---|---|---|---|
| 3,742,179 | A | 6/1973 | Harnden, Jr. |
| 3,786,220 | A | 1/1974 | Harnden, Jr. |
| 4,013,859 | A | 3/1977 | Peters, Jr. |
| 4,191,875 | A | 3/1980 | Cunningham |
| 4,275,281 | A | 6/1981 | Kiuchi |
| 4,308,443 | A | 12/1981 | Tucker et al. |
| 4,429,205 | A | 1/1984 | Cox |
| 4,820,891 | A | 4/1989 | Tanaka et al. |
| 4,962,292 | A | 10/1990 | Aoki |
| 6,018,154 | A | 1/2000 | Izaki et al. |
| 6,403,932 | B1 | 6/2002 | Nelson et al. |
| 6,630,650 | B2 | 10/2003 | Bassill et al. |
| 7,102,109 | B2 | 9/2006 | Niiyama et al. |
| 7,573,005 | B2 | 8/2009 | Clothier |
| 7,692,121 | B2 | 4/2010 | Pinilla et al. |
| 8,344,296 | B2 | 1/2013 | Metz et al. |
| 8,378,274 | B2 | 2/2013 | Fujinami et al. |
| 8,563,905 | B2 | 10/2013 | Boer et al. |
| 8,598,497 | B2 | 12/2013 | Broders et al. |
| 8,729,434 | B2 | 5/2014 | Tominaga et al. |
| 8,803,048 | B2 | 8/2014 | Bassill et al. |
| 2003/0035309 | A1 | 2/2003 | Nadot et al. |
| 2004/0240898 | A1* | 12/2004 | Nonaka ..... H05B 6/145 399/33 |
| 2006/0289495 | A1 | 12/2006 | Thomas et al. |
| 2010/0288754 | A1 | 11/2010 | Ookuma |
| 2011/0290787 | A1 | 12/2011 | Bassill et al. |
| 2012/0103977 | A1 | 5/2012 | Qiu et al. |
| 2012/0118874 | A1* | 5/2012 | Williams ..... H05B 6/1209 219/620 |
| 2012/0250366 | A1* | 10/2012 | Wang ..... H02M 3/33523 363/21.15 |
| 2012/0305546 | A1 | 12/2012 | Filippa et al. |

FOREIGN PATENT DOCUMENTS

| | | | |
|---|---|---|---|
| JP | 2006351300 | A * | 12/2006 |
| JP | 2006351371 | A | 12/2006 |
| WO | 2004107819 | A1 | 12/2004 |

OTHER PUBLICATIONS

Thermador Brings Sensor Dome Infrared Sensor Technology and the Industry's Most Powerful Heating Element to Induction Cooktops; http://www.thermador.com/; Last updated: Oct. 6, 2009 (New York, NY); Last accessed: Aug. 5, 2015. 2 pages.

* cited by examiner

INDUCTION COOKING APPLIANCE

FIELD OF THE INVENTION

The present invention relates to induction stoves. More particularly, the present invention relates to induction stove assemblies having improved safety and convenience and devices for improving the safety and convenience of an induction stove.

BACKGROUND OF THE INVENTION

Like a traditional electric stove, an induction stove uses electricity to generate heat. However, instead of heating a resistive element (such as a coil of metal) by passing electric current through it, an induction stove generates an oscillating magnetic field that causes the cooking vessel itself to be heated. The term "cooking vessel," as used throughout this specification, refers to any pot, pan, skillet or other article in which food or other material is placed to be heated on a stove.

In an induction stove, a wire coil located beneath the cook-top receives an alternating electrical current, and thereby creates an oscillating magnetic field. When a cooking vessel made from a ferromagnetic material is placed on the cook-top, the oscillating magnetic field causes the ferromagnetic material to heat up. The ferromagnetic material is heated by means of magnetic hysteresis loss in the ferromagnetic material as well as by eddy currents created in the ferromagnetic material (which generate heat due to the electrical resistance of the material). The mechanisms by which an induction stove generates heat in a cooking vessel are well known to those of skill in the art. Typically, no portion of the cook-top itself is directly heated by the induction heating element, unlike in a traditional electric stove, where a circular heating element is heated in order to heat a cooking vessel that is placed thereon.

Due to the numerous advantages associated with use of induction stoves, they have become popular all over the world. The variety of locations in which induction stoves are used means that induction stoves encounter a variety of electrical power systems from which they draw electricity. In the U.S., for example, the standard voltage in North America of the general-purpose AC power supply is between 100 and 127 V, while in most of Europe, it is around 230 V. It is disadvantageous for manufacturers of induction stoves to be required to outfit their products with numerous different electrical components to accommodate different markets around the world. It is similarly disadvantageous for individuals who move from one region to another to be required to purchase an adaptor or even a replacement induction stove.

Also, because they are fully electric, induction stoves create the possibility of improved temperature sensing and temperature and cooking control. Typical cook-tops are not able to monitor or control the temperature of the cooking vessel directly. For example, in gas stoves, the only control a user has is over the flame height. The ability to control the temperature of the cooking vessel would provide cooks with better control over their preparation of food. Better temperature control would also enable improved safety features, like auto shut off and the like.

Finally, induction stoves are popular for mobile installations such as in recreational and commercial boats, recreational vehicles, and campers. These installations create additional safety concerns because of the additional risk of spilling during cooking, which arises because the induction stove is effectively in motion. Boat safety organizations have created safety standards to guide consumers in this area, and these include requirements related to the angle from horizontal at which a cooking vessel will slide off of a cook-top. One such organization has set a minimum pitch angle of a cook-top (measured from horizontal) before which a cooking vessel will fall or slide off in order for that cook-top to be considered safe.

What is desired therefore, is an assembly and/or device that will improve the compatibility of induction stoves with a variety of electrical power supply grids, while enabling an induction stove to maintain consistent power levels for a setting regardless of input voltage or frequency. What is also desired is an assembly and/or device that will protect the cook-top surface of an induction stove while permitting better control over the temperature in the cooking vessel. What is further desired is an assembly and/or device that will improve the safety of an induction stove installed in a mobile environment.

SUMMARY OF THE INVENTION

In order to overcome the deficiencies of the prior art and to achieve at least some of the objects and advantages listed, the invention comprises a system for operation of an induction stove, including an AC to DC voltage converter receiving AC voltage from a power input, a voltage sensing unit coupled to the voltage converter, the voltage sensing unit having an optocoupler, and a processor coupled to the voltage sensing unit for receiving voltage information from the voltage sensing unit and controlling at least one of an input voltage, an input current, and an oscillation frequency of at least one heating coil of the induction stove based at least in part on the voltage information.

In some embodiments, the voltage converter is a bridge rectifier. In additional embodiments, the voltage converter includes a filter for smoothing the output DC voltage from the converter.

In certain embodiments, the voltage sensing unit further comprises at least one voltage divider coupled to the voltage converter for dividing the voltage received from the voltage converter. In some of these embodiments, the at least one voltage divider is a resistor.

In some embodiments, the voltage sensing unit further includes a voltage to current converter coupled to the optocoupler, the converter receiving an input voltage and transmitting an output current to the optocoupler, wherein the input voltage and the output current have a linear relationship. In additional embodiments, the voltage sensing unit further includes a current to voltage converter coupled to the optocoupler, the converter receiving an input current from the optocoupler and transmitting an output voltage, wherein the input current and the output voltage have a linear relationship.

In certain embodiments, the system further includes a user input device that receives a power level selection from a user and transmits it to the processor. In some of these embodiments, the processor controls the at least one of the input voltage, the input current and the oscillation frequency of the at least one heating coil of the induction stove based at least in part on the power level selection from the user. In additional embodiments, the processor includes a software for calculating an initial drive voltage for the at least one heating coil based at least in part on the voltage information received from the voltage sensing unit at a selected power level, a software for calculating an initial input current to the at least one heating coil to achieve the selected power level, a software for calculating a drive frequency of the at least one heating coil for the selected power level, and a software for adjusting at least one of the input voltage, the input current and the oscillation frequency based at least in part on a coil current measured by at least one sensor that measures a current in the coil.

The invention also comprises a voltage sensing circuit for an induction stove, including at least one voltage divider, a voltage to current converter coupled to the at least one voltage divider, an optocoupler coupled to the voltage to current converter, and a current to voltage converter coupled to the optocoupler, wherein the voltage sensing circuit senses a DC voltage.

The invention further includes a voltage sensing circuit for an induction stove, including at least one voltage divider, a voltage to frequency converter coupled to the at least one voltage divider, an optocoupler coupled to the voltage to frequency converter, and a frequency to voltage converter coupled to the optocoupler.

A system for operation of an induction stove is also provided, including an AC to DC voltage converter receiving AC voltage from a power input, a voltage sensing unit coupled to the converter, the unit receiving a DC voltage, a processor coupled to the voltage sensing unit, the processor receiving voltage information from said unit and controlling at least one of an input voltage, an input current, and an oscillation frequency of at least one heating coil of the induction stove.

In certain embodiments, the voltage sensing is an optocoupler. In some of these embodiments, the optocoupler is a linear optocoupler. In additional embodiments, the optocoupler includes at least one LED and at least one photodiode.

A method for operating an induction stove is further provided, including the steps of converting an AC voltage from a power input to a DC voltage via an AC to DC voltage converter, supplying the DC voltage to a voltage sensing unit coupled to the converter, the voltage sensing unit including an optocoupler, transmitting voltage information from the voltage sensing unit to a processor, and controlling at least one of an input voltage, an input current, and an oscillation frequency of at least one heating coil of the induction stove via the processor based at least in part on the voltage information.

In some embodiments, the method also includes the step of smoothing the voltage received from the converter via a filter coupled to the converter.

In certain embodiments, the method further includes the step of dividing the voltage received from the converter via at least one voltage divider.

In some embodiments, the method also includes the step of receiving an input voltage from the converter and transmitting an output current to the optocoupler via a voltage to current converter coupled to the optocoupler. In additional embodiments, the method further includes the step of receiving an input current from the optocoupler and transmitting an output voltage to the processor via a current to voltage converter coupled to the optocoupler.

In some cases, the method also includes the step of receiving a power level selection from a user via a user input device, wherein the step of controlling the at least one of the input voltage, the input current, and the oscillation frequency to the at least one heating coil of the induction stove is based at least in part on the power level selection from the user.

In certain embodiments, the method also includes the steps of calculating an initial drive voltage for the at least one heating coil based at least in part on the voltage information received from the voltage sensing unit at a selected power level, calculating an initial input current to the at least one heating coil to achieve the selected power level, calculating a drive frequency of the at least one heating coil for the selected power level, and adjusting at least one of the input voltage, the input current and the oscillation frequency based at least in part on a coil current measured by at least one sensor that measures a current in the coil.

The invention further comprises an induction stove, including a heating coil, an AC to DC voltage converter receiving AC voltage from a power input, a voltage sensing unit coupled to the converter and comprising an optocoupler, the unit receiving a DC voltage from the converter, and a processor receiving voltage information from the voltage sensing unit and controlling at least one of an input voltage, an input current, and an oscillation frequency of the heating coil based on the voltage information.

In some embodiments, the voltage sensing unit further includes at least one voltage divider coupled to the voltage converter for dividing the voltage received from the voltage converter.

In certain embodiments, the voltage sensing unit further includes a voltage to current converter coupled to the optocoupler, the converter receiving an input voltage and transmitting an output current to the optocoupler, wherein the input voltage and the output current have a linear relationship. In additional embodiments, the voltage sensing unit further includes a current to voltage converter coupled to thes optocoupler, the converter receiving an input current from said optocoupler and transmitting an output voltage, wherein the input current and the output voltage have a linear relationship.

In some embodiments, the system also includes a user input device that receives a power level selection from a user and transmits it to the processor. In certain of these embodiments, the processor controls the at least one of the input voltage, the input current and the oscillation frequency of the at least one heating coil of the induction stove based at least in part on the power level selection from the user.

In some cases, the processor includes a software for calculating an initial drive voltage for the at least one heating coil based at least in part on the voltage information received from the voltage sensing unit at a selected power level, a software for calculating an initial input current to the at least one heating coil to achieve the selected power level, a software for calculating a drive frequency of the at least one heating coil for the selected power level, and a software for adjusting at least one of the input voltage, the input current and the oscillation frequency based at least in part on a coil current measured by at least one sensor that measures a current in the coil.

Other objects of the invention and its particular features and advantages will become more apparent from consideration of the following drawings and accompanying detailed description.

DETAILED DESCRIPTION OF THE INVENTION

Figure 1:
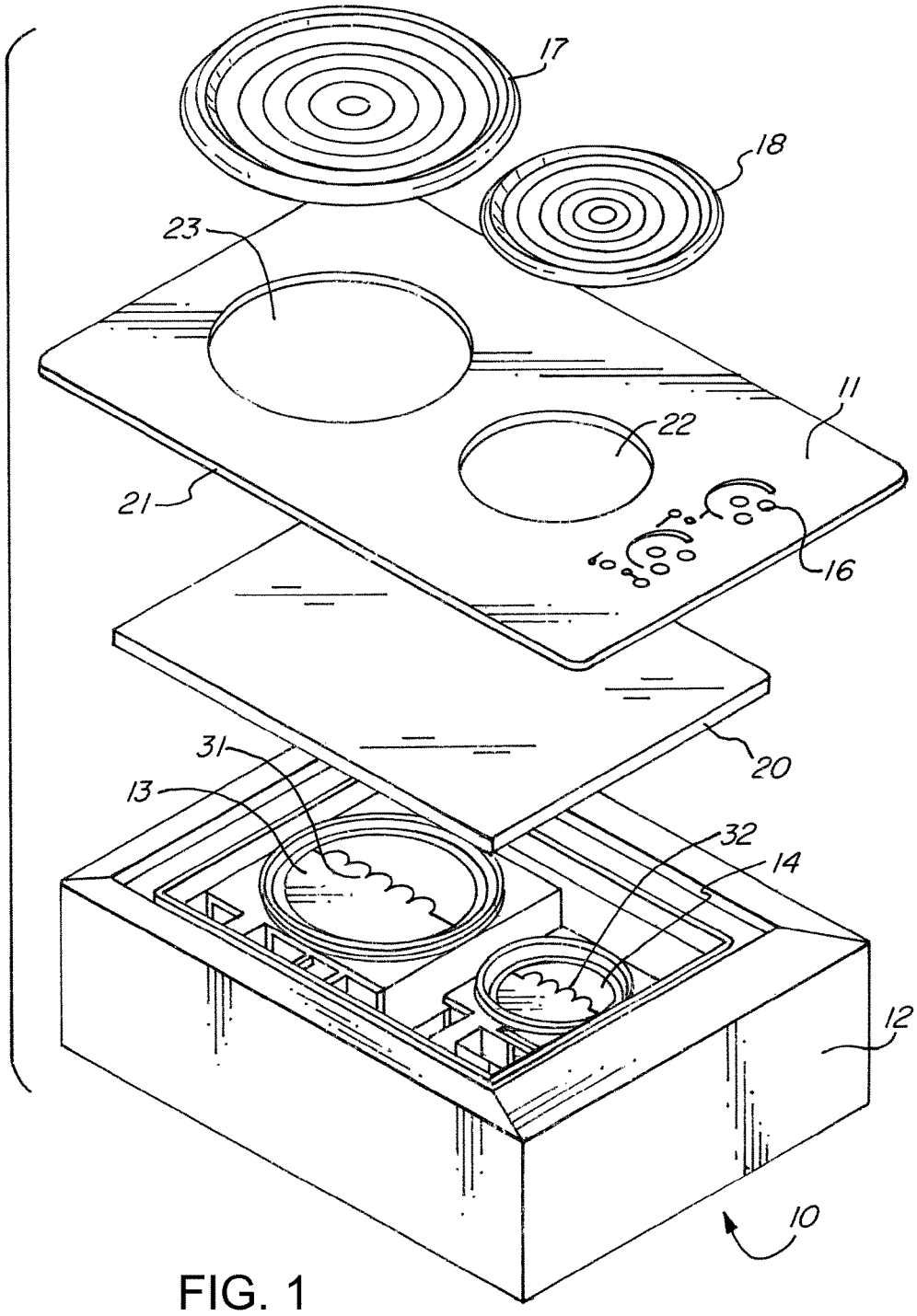
FIG. 1 is a perspective exploded view of one exemplary embodiment of an induction stove according to the present invention.

FIG. 1 illustrates one exemplary embodiment of an induction stove in accordance with the present invention. The induction stove (10) has a cook-top (11) that rests on and is secured to a cabinet (12). The stove includes at least one induction coil (31, 32) (or burner) having at least one induction cooking zone (13, 14 respectively). The stove (10) utilizes the coil(s) (31, 32) to create an oscillating magnetic field that interacts with and generates an amount of heat in a cooking vessel located in an induction cooking zone of the stove. The stove (10) further includes user interface/controls (16), e.g., power selection buttons and temperature selection buttons for each cooking zone.

The induction cooking zones (13, 14) may have different sizes. For example, as shown in this figure, zone (13) is a larger cooking zone than zone (14) and has a larger horizontal extent. A larger induction cooking zone is able to heat a large cooking vessel quicker and more evenly than a smaller induction cooking zone would heat that same vessel. Each induction cooking zone (13, 14) has associated with it a recess (23, 22 respectively) formed in the cook-top (11). The recesses (23, 22) in the cook-top (11) shown in FIG. 1 are circular in order to correspond to the overall shape of the magnetic fields formed in the induction cooking zones, but can also have a different shape.

In the embodiment shown in FIG. 1, the cook-top (11) comprises a top panel (21) and a bottom panel (20). The top panel (21) is made of any material suitable for an induction stove cook-top, including ceramic, glass, high density thermoplastics, non-ferromagnetic metals (such as aluminum), etc. The bottom panel (20) is secured to the underside of the top panel (21) in a permanent or semi-permanent fashion by use of adhesives or any other means for joining ceramics, glasses, or other suitable materials. Generally, the bottom panel (20) is made of the same material used for the top panel (21), but the panels may be of different materials so long as they are suitable for use as an induction stove cook-top. It has been found that ceramic glass is advantageously used for both the top panel and the bottom panel. It is understood that the stove design illustrated in this figure is only exemplary and other suitable designs may be used in accordance with the present invention. For example, many preferred embodiments comprise a smooth cook-top formed of ceramic, glass, or other suitable materials that does not have recesses.

The induction stove (10) may also include one or more pads (17, 18) each associated with a cooking zone and a recess, as shown in FIG. 1. The pads may have protrusions on their undersides that interact with corresponding recesses in the cook-top (11) to prevent unwanted horizontal (or sliding) movement of the pads with respect to the cook-top. While the pads resist horizontal movement, they are easily removable by vertically lifting the pads off of the cook-top. The pads are not permanently or semi-permanently secured to the cook-top, thus enabling them to be easily removed and replaced with other, similar pads.

It is understood that other types of pads or mats may be used with the induction stove of the present invention. Another exemplary embodiment of a mat is shown in FIGS. 2A-2E. The mat (50) comprises a thermally insulating portion (52) and a thermally transmissive portion (54). The thermally transmissive portion (54) is formed from a material having a higher thermal conductivity than a material of which the thermally insulating portion (52) is formed. The thermally insulating portion (52) is typically formed of a material that is resilient, flexible, and that provides sufficient surface tack to prevent it from sliding off of a smooth cook-top. The mat (50) is particularly well suited to smooth cook-tops that do not have recesses.

The generally rectangular thermally insulating portion (52) includes two openings for two thermally transmissive portions or disks (54). The insulating portion (52) is made of a non-flammable and non-ferrous material, such as silicone. The function of the thermally insulating portion (52) of the mat (50) is to limit the amount of heat that can build up in the cook-top surface (11) of the stove (10) due to the cooking vessel being heated. The mat (50) in general and the insulating portion (52) in particular also protects the cook-top (11) of scratches or cracks.

Figure 2A:
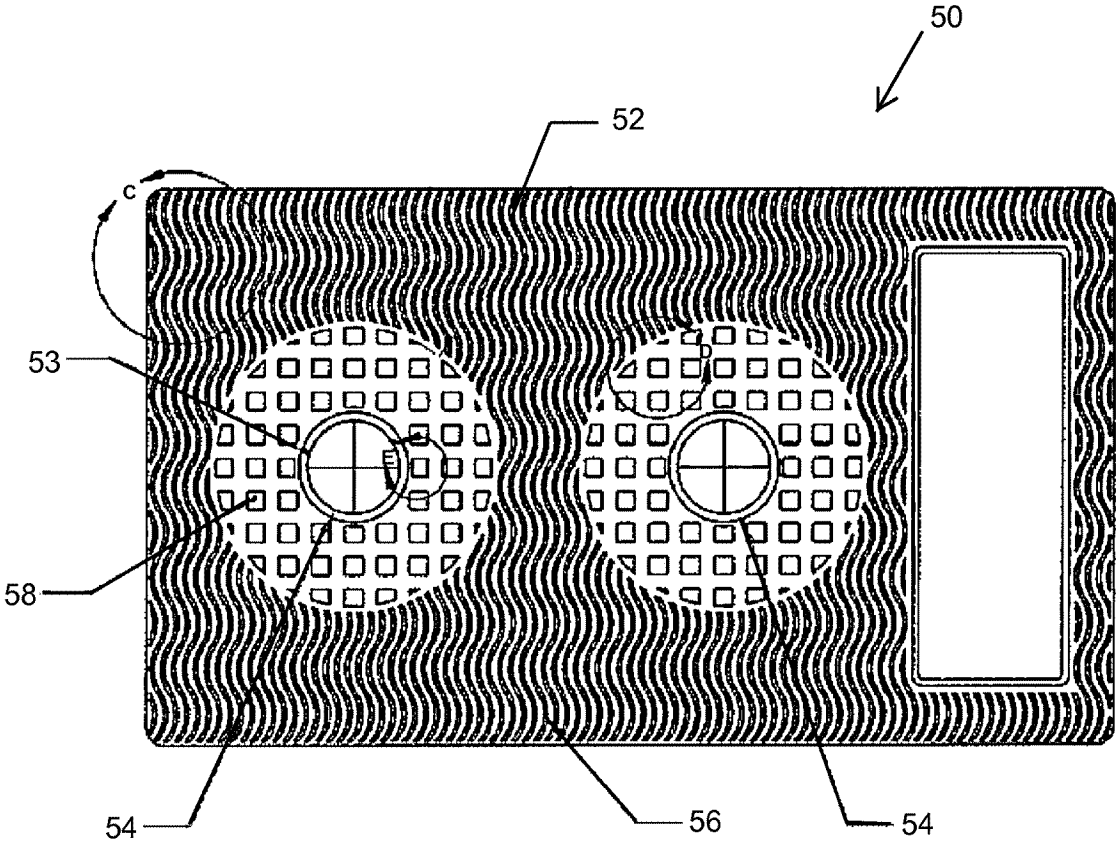
FIG. 2A is a bottom view of an insulating mat for use with the induction stove of the present invention.
Figure 2B:
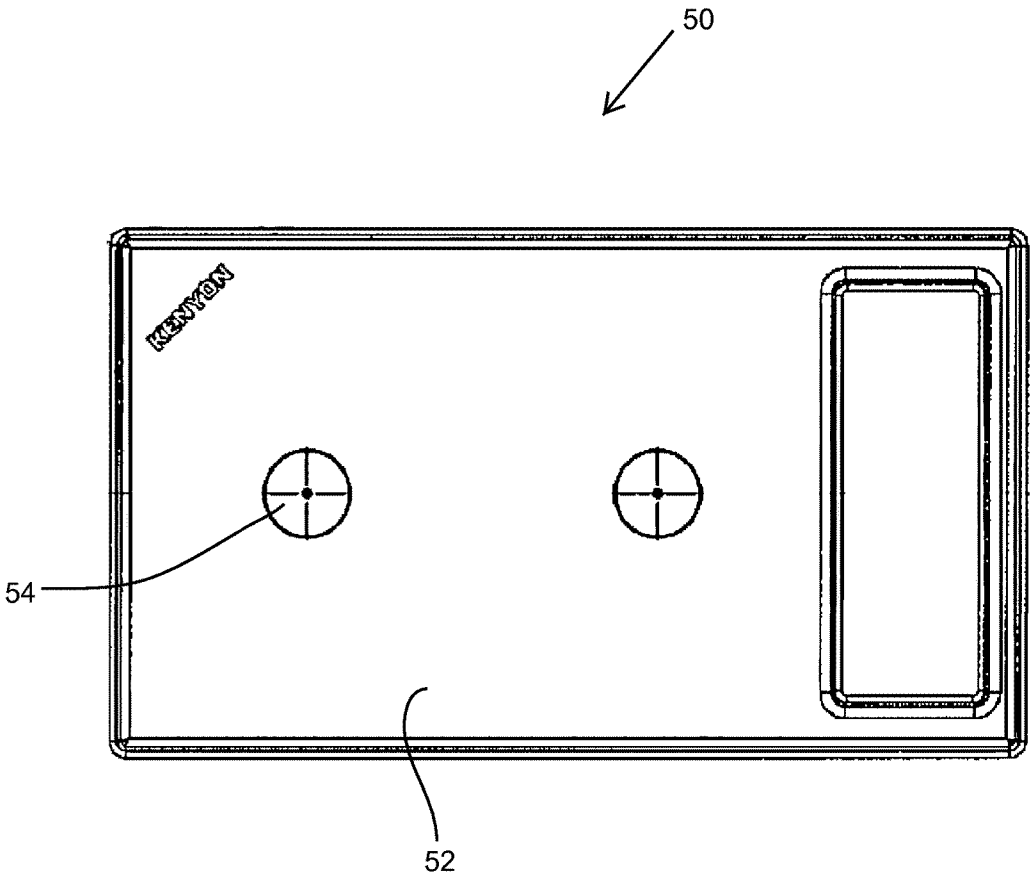
FIG. 2B is a top view of the mat of FIG. 2A.
Figure 2D:
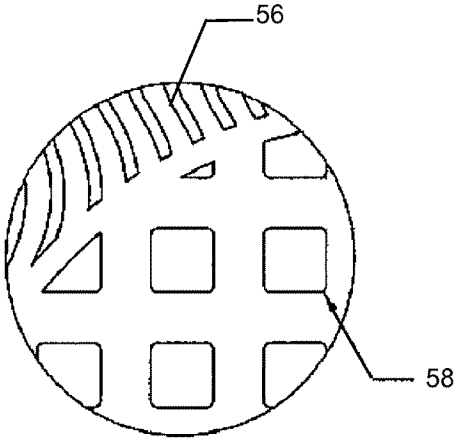
FIG. 2D is an enlarged view of a portion of the mat labeled "D" in FIG. 2A.
Figure 2E:
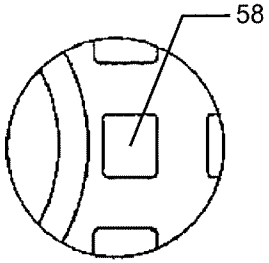
FIG. 2E is an enlarged view of a portion of the mat labeled "E" in FIG. 2A.
Figure 2C:
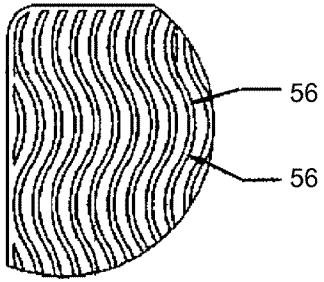
FIG. 2C is an enlarged view of a portion of the mat labeled "C" in FIG. 2A.

The bottom view of the mat (50) in FIG. 2A shows the pattern of protrusions formed on the bottom surface of the thermally insulating portion (52). This pattern improves the capability of the mat (50) for remaining on the cook-top (11) even when subjected to pitch angles. The pattern is shown in additional detail in FIGS. 2C-2E and comprises square protrusions (58) in the area that would be substantially underneath a cooking vessel and wave-shaped protrusions (56) surrounding those areas. The area of square protrusions (58) generally corresponds to the area in which an induction coil of the stove (10) will heat a cooking vessel placed therein. Applicants' tests have determined that this pattern of protrusions in the embodiment shown prevents the mat from slipping off of a wet cook-top until a 45° pitch is reached. However, it is understood that other patterns of protrusions may be used on the mat.

The thermally transmissive portion (54) is formed of a material that will conduct heat generated in the cooking vessel to a spot on the cook-top, such as e.g. aluminum. The transmissive portions (54) of the mat (50) are located so that they are generally in the center of the induction cooking zones of the stove, but the location of the transmissive portion in the mat can be varied based on the particular embodiment. The transmissive portions (54) make direct contact with both the bottom surface of a cooking vessel and the top surface of the cook-top of the stove. The function of the transmissive member is to conduct the heat generated in the cooking vessel to a temperature sensor located underneath or at the surface of the cook-top. The transmissive member permits the stove to more directly monitor the temperature in the cooking vessel despite the presence of the thermally insulating portion of the mat.

Figure 3:
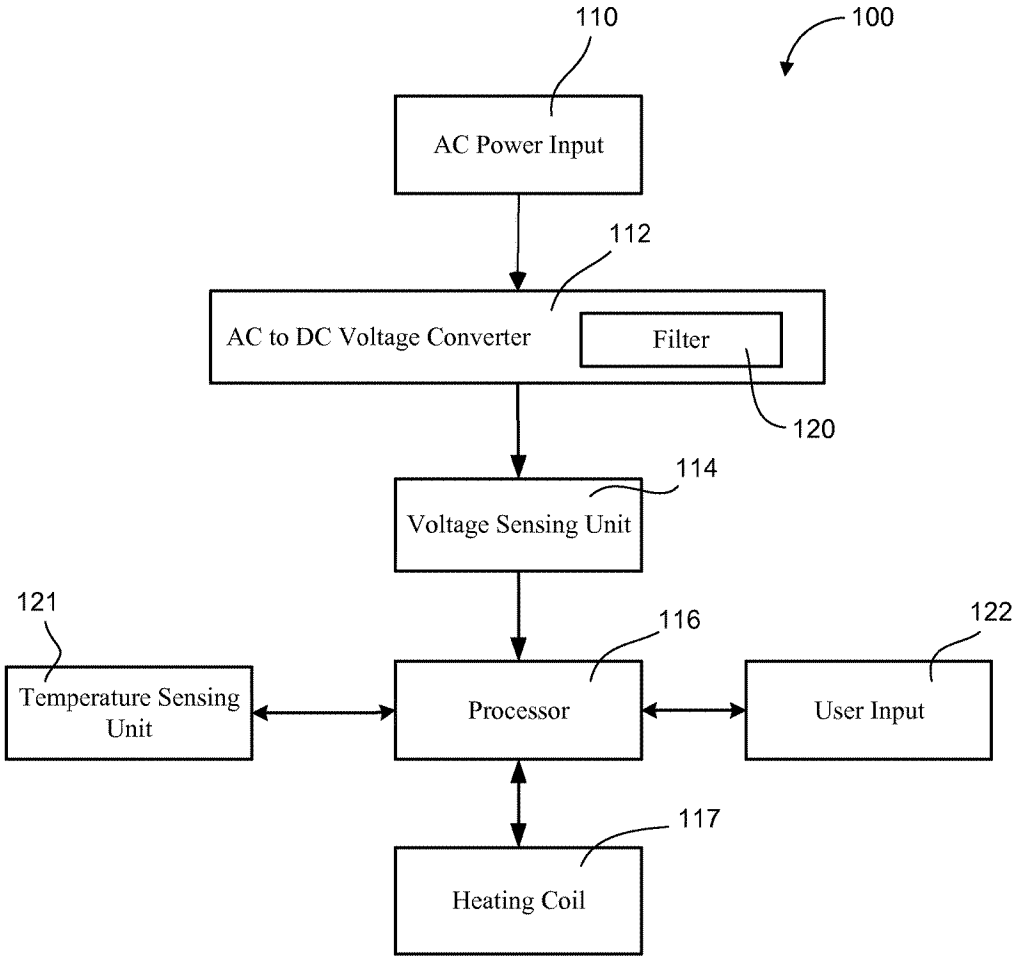
FIG. 3 is a block diagram of a system for operation of the induction stove in accordance with the present invention.

FIG. 3 is a block diagram of a system for operation of the induction stove in accordance with the present invention. The system (100) includes an AC power input (110) and one or more sensing units (112) that measure the AC input voltage. An AC to direct current (DC) converter (112) is coupled to the AC power input (110). The converter converts the input AC voltage to the output DC voltage. Any suitable converter may be used with the system of the present invention. In certain advantageous embodiments, a bridge rectifier is used in the converter circuitry (112). A bridge rectifier provides full-wave rectification from a two-wire AC input, resulting in lower cost and weight as compared to a rectifier with a 3-wire input from a transformer with a secondary winding.

In additional advantageous embodiments, the voltage converter (112) includes a filter (120), e.g. at least one capacitor, that functions to smooth out the output of the converter to product a steady constant DC voltage. Any type of filter known in the art may be used in accordance with the invention.

The output DC voltage from the converter (112) is received by the voltage sensing unit (114) coupled to the converter. The voltage sensing unit (112) measures the input voltage from the AC power input and transmits the measured voltage information to a processor (116). The voltage sensing unit (112) also functions as an isolation unit to block high voltages and voltage transients so that a surge in the power input line will not disrupt or destroy the processor (116).

Figure 4:
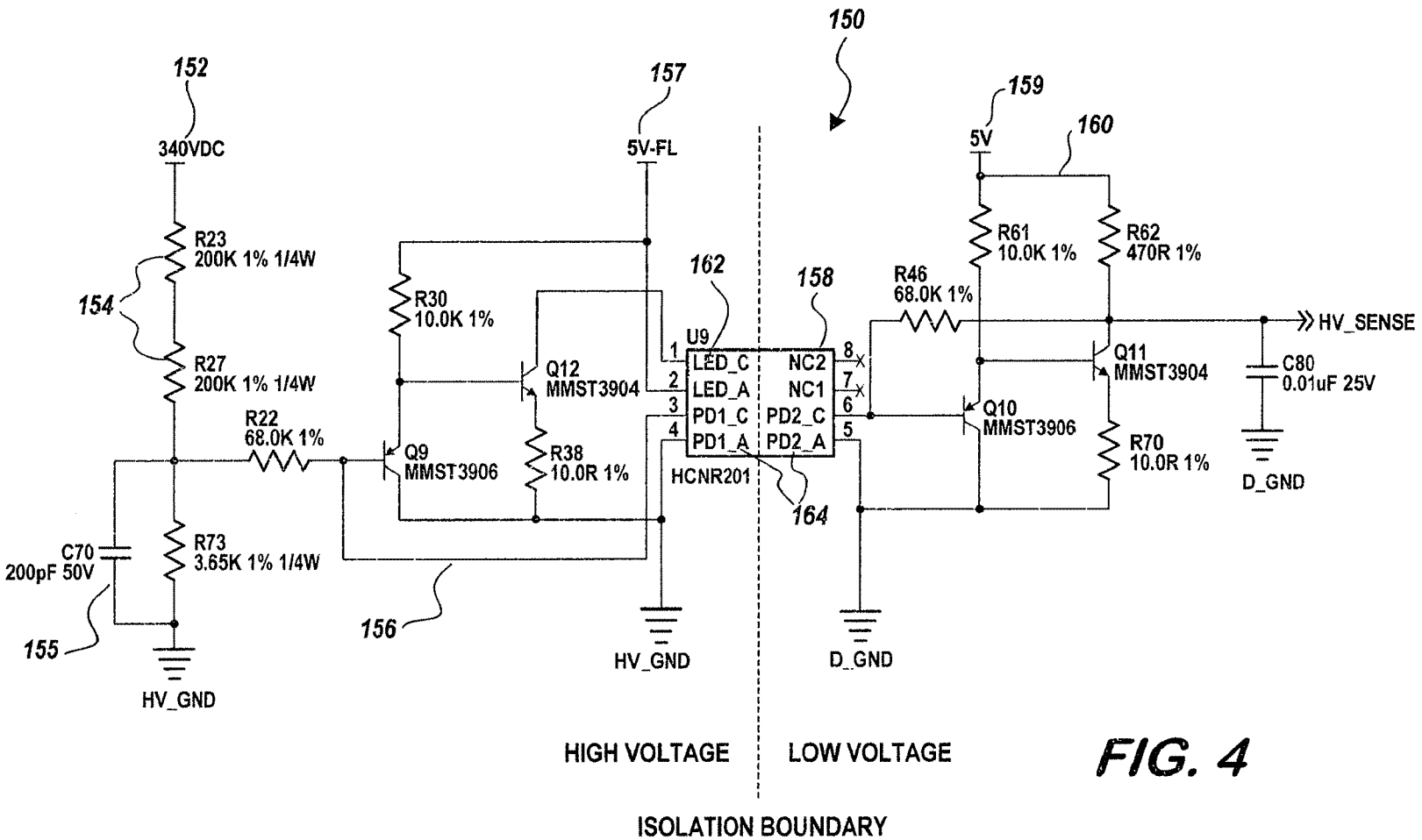
FIG. 4 is a circuit diagram of one embodiment of a voltage sensing unit of the system for operation of the induction stove of FIG. 3.

One exemplary embodiment of the voltage sensing unit in accordance with the present invention is illustrated in FIG. 4. The sensing unit (150) receives a DC voltage input (152)—340 VDC in this example—from the AC to DC converter (112) described above. This voltage is then transmitted to at least one voltage divider (154), which produces an output voltage that is a fraction of its input voltage. In the embodiment illustrated in this figure, the voltage divider (154) comprises two resistors connected in series; however, it is understood that other suitable voltage dividers may also be used. In some embodiments, the sensing unit (150) may also include a noise filter (155), such as e.g., a capacitor, coupled to the voltage divider (154) for filtering undesirable noise components from the DC voltage in the sensing unit (150).

After the voltage is reduced by the divider (154), it is supplied to a voltage-to-current converter (156) that converts an input voltage into an output current. In some advantageous embodiments, the input voltage and the output current have a linear relationship. The advantage of using DC current signal as opposed to DC voltage signal is that current signals are exactly equal in magnitude throughout the series circuit loop carrying current from the source (measuring device) to the load (controller), whereas voltage signals in a parallel circuit may vary from one end to the other due to resistive wire losses. Additionally, current-sensing instruments typically have low impedances (while voltage-sensing instruments have high impedances), which gives current-sensing instruments greater electrical noise immunity. It is understood that the voltage-to-current converter (156) illustrated in this figure is only exemplary and that any other suitable converter may be used. The converter (156) may include an additional voltage input (157) to compensate for signal loss through this circuit to ensure an accurate voltage measurement by the sensing unit (150).

Once the DC voltage signal is converted into the DC current signal by the converter (156), the DC current signal is supplied to an optocoupler (158) coupled to the converter. In one advantageous embodiment, a linear optocoupler is used. The optocoupler comprises at least one source of light (162) and at least one photosensor (164), with a closed optical channel in between. In the embodiment illustrated in FIG. 4, the source of light (62) comprises one or more light-emitting diodes (LED) and the photosensor (164) comprises one or more photodiodes. It is understood, however, that other types of optocouplers can be used as well. The LEDs (162) convert the electrical input signal into light, which is then detected by the photodiodes that convert it into current. The optocoupler (158) functions to provide an electrical isolation boundary between the power input (110) and the processor (116) to prevent surges in the power input line from disrupting or destroying the processor (116). The use of an optocoupler in the voltage sensing unit is advantageous over the use of a transformer because it allows for a more accurate voltage measurement and also provides a better electrical isolation between the system components.

The current output from the optocoupler (158) is then transmitted to a current-to-voltage converter (160) connected to the optocoupler. The converter (160) converts the input current from the optocoupler (158) to a proportional amount of output voltage. In some embodiments, the converter (160) includes an additional voltage input (159) to minimize signal loss through the circuit to facilitate a more accurate voltage measurement by the sensing unit (150).

It should be understood that various components of the voltage sensing unit (150) illustrated in FIG. 4 and described above are only exemplary and may be replaced by other suitable components known in the art.

Figure 5:
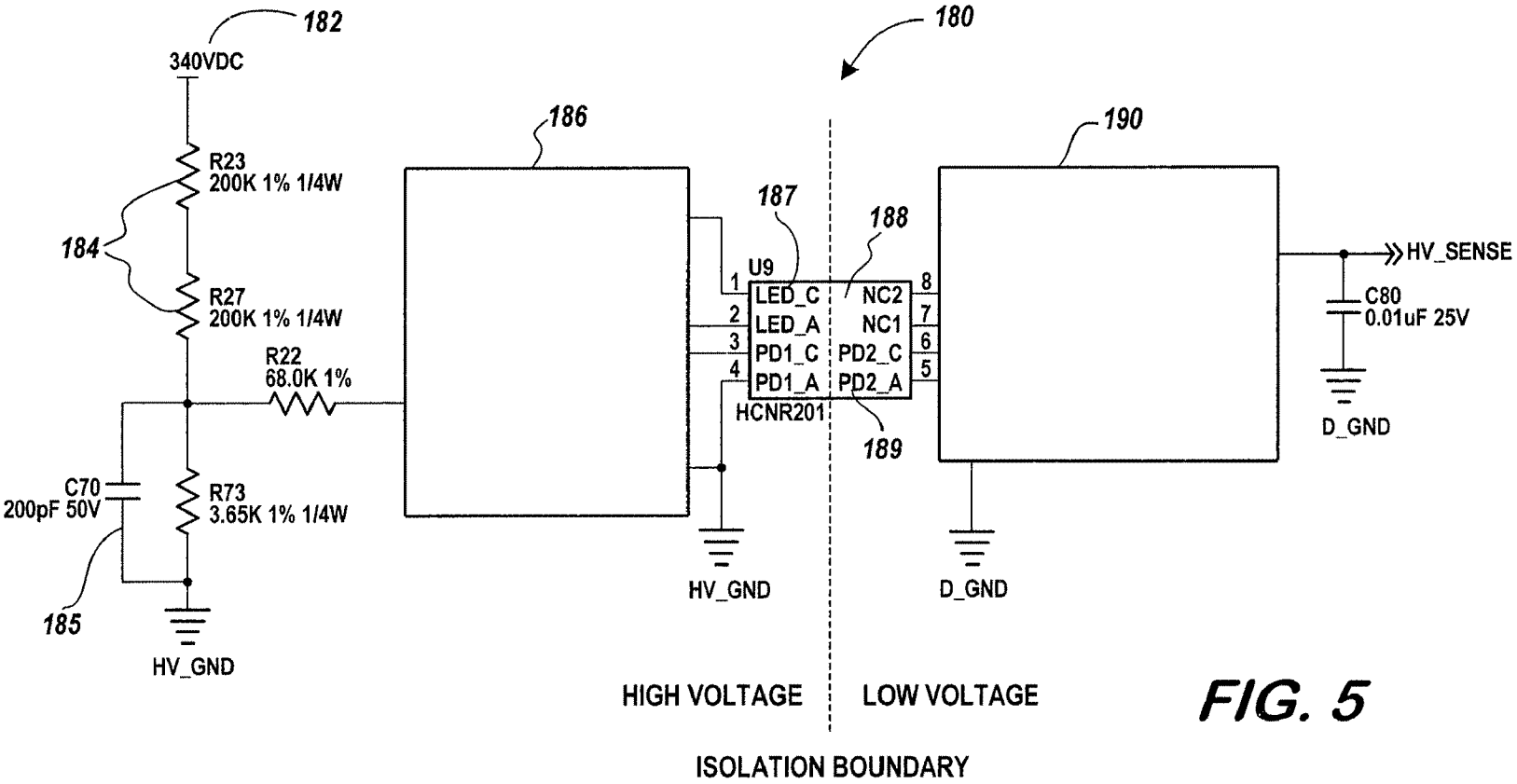
FIG. 5 is a circuit diagram of an additional embodiment of a voltage sensing unit of the system for operation of the induction stove of FIG. 3.

Another exemplary embodiment of the voltage sensing unit is shown in FIG. 5. In this embodiment, the voltage sensing unit (180) has a power input (182), a voltage divider (184), a noise filter (185), and an optocoupler (188) similar to those described above in reference to FIG. 4. However, in this embodiment, the voltage-to-current and current-to-voltage converters are replaced by a voltage-to-frequency converter (186) and a frequency-to-voltage converter (190). The voltage-to-frequency converter (186) receives the DC voltage input from the voltage divider (184) and converts it to a frequency signal, which is then supplied to the optocoupler (188). The optocoupler turns the LEDs (187) on and off at the input frequency and the photodiodes (189) detect this frequency, which is then transmitted from the optocoupler (186) to the frequency-to-voltage converter (190). The converter (190) converts the input frequency into an output voltage, which is then transmitted to the processor. Again, this design of the voltage sensing unit is only exemplary and other suitable designs may be utilized.

In additional embodiments, the frequency-to-voltage converter (190) connected between the optocoupler and the processor may be eliminated. In this case, the frequency output from the optocoupler is transmitted to the processor as a digital signal. The processor then calculates the frequency of this input signal from the optocoupler and determines the input AC voltage based on this frequency.

Referring back to FIG. 3, the processor (116) is connected to at least one heating coil (117) of the induction stove. The system's control circuitry includes a sensor for measuring the current in at least one induction heating coil (117) and a driver for driving the coil (117) at a plurality of frequencies, both coupled to the processor (116). The system (100) further includes a user input device (122) that receives a power level and/or temperature selection from a user and transmits it to the processor (116), which drives the coil (117) to achieve the selected power level/temperature.

Any suitable type of a processor may be used in accordance with the present invention. In one exemplary embodiment, dsPIC33FJXXGSXXX microprocessor model, and in particular, dsPIC33FJ16GS504 model, is used with the system (100).

The processor (116) has a software for controlling the heating coil (117) so that it maintains consistent power levels at a selected setting regardless of the input voltage or frequency. The software takes the measured input voltage from the voltage sensing unit (114) and uses it to calculate the initial drive voltage for the coil (117) at the selected power level. This is then used to calculate the initial current that should be supplied to the coil (117) to achieve the selected power level. The software then calculates the frequency at which to drive the coil (117) for that power level. The software adjusts the frequency based on the measured coil current. If the coil current is too low (and therefore the power is too low), the circuitry will lower the coil drive frequency, which makes the coil frequency closer to the optimum resonance frequency of the coil. If the coil current is too high (and therefore the power is too high), the circuitry will raise the coil drive frequency to make it further from the optimum resonance frequency of the coil.

The induction stove of the present invention is advantageous in that it monitors the AC input voltage and current in real time and adjusts accordingly so that the stove will operate over a range of input voltages and currents. For example, a particularly advantageous embodiment permits the stove to function over the range of 100 VAC up to 250 VAC at 50 Hz or 60 Hz. Additionally, the induction stove of the present invention makes it possible to maintain consistent power levels for a setting regardless of input voltage or frequency.

Figure 6:
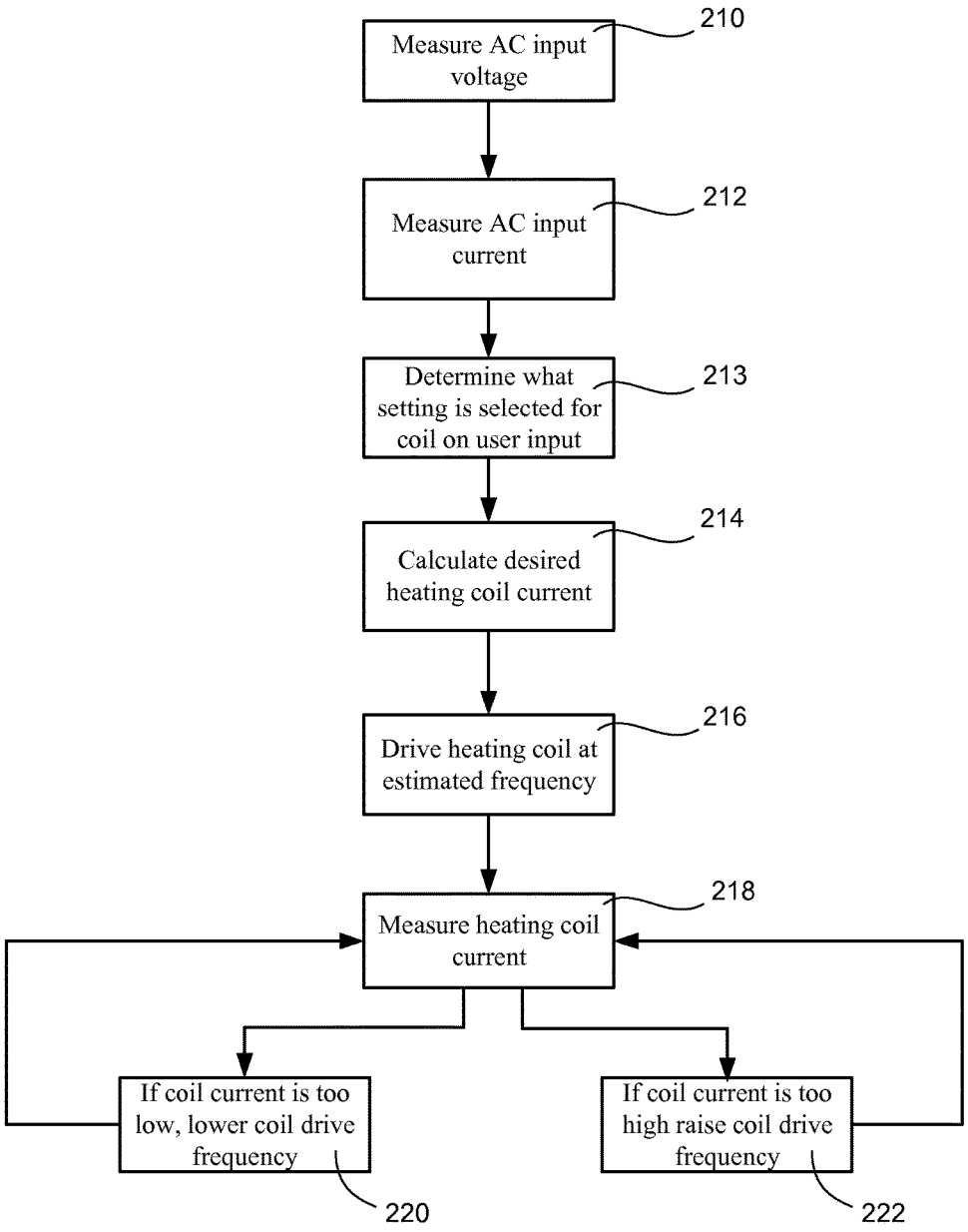
FIG. 6 is a system operation flow chart for one embodiment of the induction stove of the present invention.

FIG. 6 illustrates an exemplary embodiment of the basic control loop logic for the system of the present invention when it is in a single burner operation condition. First, the system measures (210) an AC input voltage from the power input line. The voltage is measured by one of the voltage sensing units described above and is transmitted to the processor. This measured voltage information is used by the processor to determine the desired current level for a particular power setting, which is either preset or is selected by a user via the user input.

Next, an AC input current is measured (212) by the system and transmitted to the processor. The input current measurement is used as an additional validation of the coil current measurement.

The system then determines (213) what setting has been selected by the user for the heating coil via the user input. This determines the desired power level. The processor then calculates (214) the desired coil current by using the AC input voltage from the voltage sensing unit to determine what the drive voltage will be and then calculating the current for the setting on the coil.

The processor then drives (216) the heating coil at an estimated frequency. The first time through, this step is based on an initial calculation of the current. After that, this step is based on the measured current in the coil.

Next, the system measures (218) the coil current via at least one sensor and transmits the measured coil current to the processor, which analyses the measured current and compares it to the desired coil current. If the coil current is too low (and therefore the power is too low), the processor will instruct (220) the coil driver to lower the coil frequency, which brings the drive circuit/coil closer to optimum resonance and therefore, higher power. If the coil current is too high (and thus the power is too high), the system will instruct (222) the driver to raise the coil frequency, which moves the drive circuit/coil farther from optimum resonance and therefore, lower power.

The system will then continuously return to the step (218) of measuring the current in the heating coil and adjusting (220, 222) the coil frequency accordingly to ensure that the induction stove maintains consistent power levels for a particular selected setting.

Figure 7:
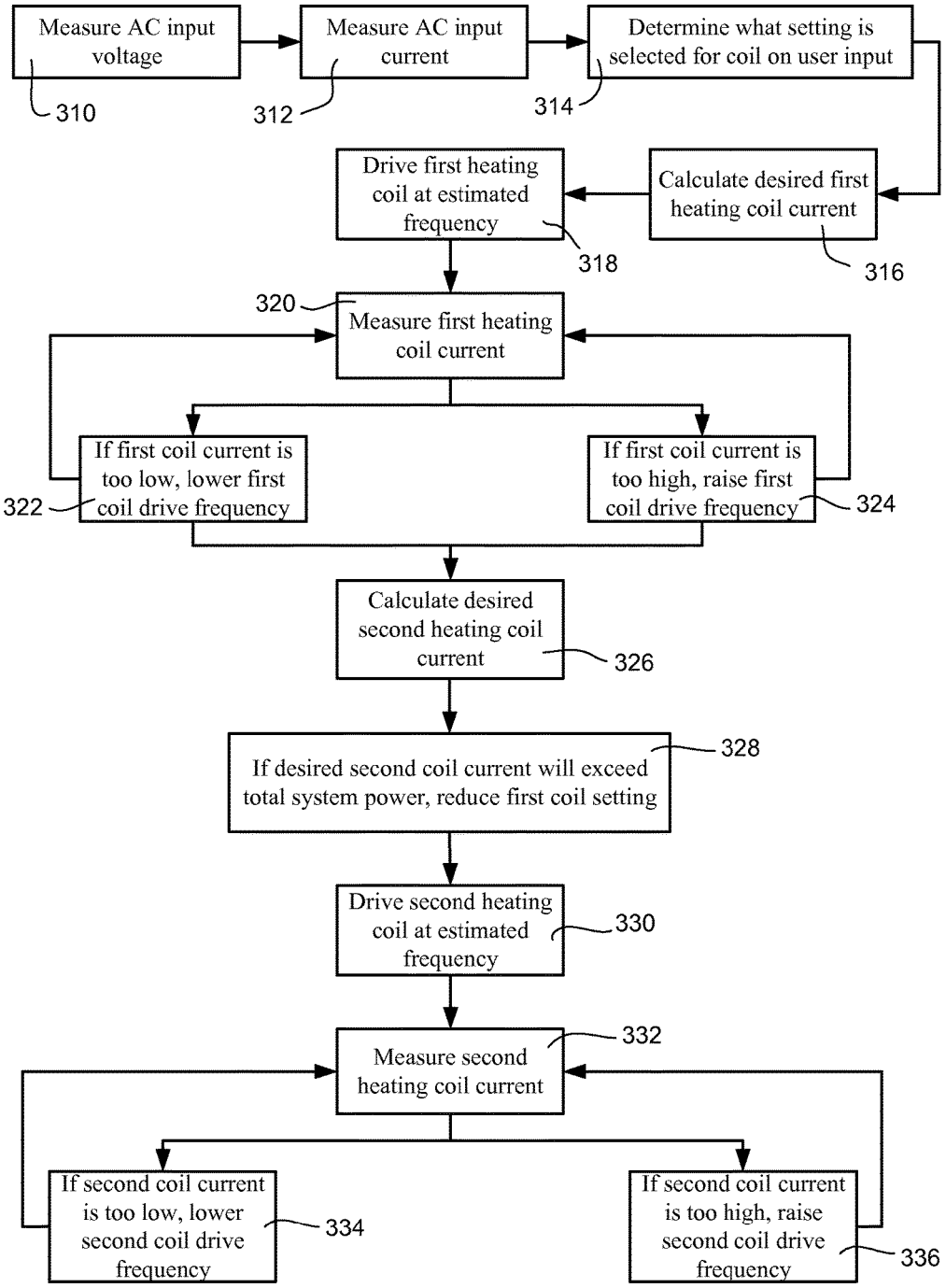
FIG. 7 is a system operation flow chart for an additional embodiment of the induction stove of the present invention.

FIG. 7 illustrates the basic control loop logic for the induction stove of the present invention with at least two induction heating coils. The software described above functions similarly in this embodiment, except that the system measures the currents at both coils and compares them against the power capacity of the complete system. Similarly to the embodiment above, the system first measures (310) an AC input voltage to determine the desired current level for a particular power setting. Then, an AC input current is measured (312) and is used to keep the maximum power draw within the specifications and to adjust the coil settings in a power sharing arrangement.

Next, the system then determines (314) what setting has been selected by the user for the heating coils via the user input, which is used to determine the desired power level. The processor then calculates (316) the desired first coil current by using the AC input voltage from the voltage sensing unit to determine what the drive voltage for the first coil will be and then calculating the current for the setting on the coils. The processor then drives (318) the first heating coil at an estimated frequency, which is first based on an initial calculation of the current, and then based on the measured current in the first coil.

Then, the system measures (320) the current in the first coil, which is compared to the desired coil current. If the current in the first coil is too low (and therefore the power is too low), the processor will instruct (322) the coil driver to lower the first coil frequency, which brings the drive circuit/coil closer to optimum resonance and therefore, higher power. If the current in the first coil is too high (and thus the power is too high), the system will instruct (324) the driver to raise the first coil frequency, which moves the drive circuit/coil farther from optimum resonance and therefore, lower power.

Next, the system calculates (326) the desired current in the second heating coil. Upon receipt of the desired power level for the second coil after the first coil has already been set per the above description, the system calculates the appropriate current to apply to the second coil based on the selected power level and, if that current plus the current being applied to the first coil exceeds the maximum total power of the system, the current to the first coil will be adjusted (328) to accommodate the current to the second coil. The opposite occurs in instances where the first coil is activated after the second coil—the system will reduce current to the second coil if the combination of the current requirements of the coils exceeds the total capacity of the system.

The processor then drives (330) the second heating coil at an estimated frequency, which is first based on an initial calculation of the current, and then based on the measured current in the second coil. The current in the second coil is then measured (332) and compared to the desired coil current. If the current in the second coil is too low (and therefore the power is too low), the frequency of the second coil is (334), which brings the coil closer to optimum resonance and therefore, higher power. If the current in the second coil is too high (and thus the power is too high), the frequency of the second coil will be raised (336), which moves the coil farther from optimum resonance and therefore, lower power.

The system monitors AC input voltage and current in the coils in real time to adjust accordingly such that the induction stove maintains consistent power levels for a particular selected setting.

In one advantageous embodiment, the induction stove operation and control system of the present invention allows the user to select a desired temperature of a cooking vessel placed on the stove. In this embodiment, the induction stove includes at least one temperature sensor positioned adjacent the cook-top in the area in which the heating coil creates heat in a cooking vessel. The stove includes memory, data processing equipment, and software, firmware, and/or hardware to receive an input from the power control that is indicative of the user's desired temperature and an input from the temperature sensor. The stove calculates the temperature in a cooking vessel being used based on the temperature sensor input and attempts to match that calculated temperature to the user-selected temperature. The stove will vary the amount of current supplied to the coil or will vary the frequency of oscillation of the current supplied to the coil in order to control the temperature of the cooking vessel. The stove's calculation of the vessel temperature takes into account the separation distance between the sensor and the vessel, the material of the cook-top, the magnetic profile of the vessel, and other relevant factors.

The following is a more detailed description of how the induction stove controls the temperature of the cooking vessel in response to the user's selection of a cooking temperature:

After the stove is set to a temperature control mode, the user inputs the desired temperature for the cooking vessel. At least one temperature sensor is mounted below the cook-top and is connected to the cook-top surface using at least one thermally conductive pad. An example of a suitable temperature sensor is an NTC thermistor. In some embodiments, the thermistor is mounted in the center of the induction coil. The temperature sensor provides a voltage signal that varies according to the temperature of the sensor. In the case of a thermistor, the electrical resistance varies with temperature and therefore the voltage of an electrical signal sent through it will also vary. In some embodiments, the voltage signal to and/or from the temperature sensor is transformed. In some embodiments, this is accomplished using one or more 2.2K resistors.

The voltage signal from the temperature sensor is then input to the processor of the stove. In some embodiments, the voltage signal is first converted from an analog signal to a digital signal containing the necessary voltage level information using, for example, one or more analog-to-digital converters. The signal received by the processing unit is then used to calculate the sensor's temperature. This is done, in some embodiments, using a lookup table based on the particular sensor's characteristics. For example, the look-up table can be provided for a particular thermistor based on its resistance versus temperature equation.

This provides a measure of the sensor temperature, so next it is advantageous to make a compensation to obtain the temperature of the cooking vessel on the other side of the cook-top from the sensor. The equation used in one embodiment of the invention to calculate the temperature of the cooking vessel based on the temperature of the sensor is:

Pot_temp=(probe_temp*factor_a)+
(change_of_probe_temp*factor_b)+
(change_of_change_of_Probe_temp*factor_c). Where, "Pot_temp" is the cooking vessel temperature and "probe_temp" is the sensor temperature. The first component, (probe_temp*factor_a), is the sensor temperature multiplied by a constant established based on the specific embodiment.

The second part of the foregoing equation, (change_of_probe_temp*factor_b), is a first compensation factor. This factor is, essentially, the velocity of the sensor temperature or, in other words, the change in the sensor temperature over time. The "factor_b" is a constant specific to the embodiment. In one embodiment of the invention, the (change_of_probe_temp*factor_b) is equivalent to taking a percentage of the change over time in the measured temperature minus the ambient temperature.

The third part of the foregoing equation, (change_of_change_of_Probe_temp*factor_c), is a second compensation factor that is, essentially the acceleration of the sensor temperature. In other words, it is the change of the change of the sensor temperature over time. The "factor_c" is a constant specific to the embodiment. In one embodiment, the velocity and acceleration compensations are calculated based on the previous 10 seconds of measurements.

These compensation factors lead to a more accurate calculation of the temperature of the cooking vessel. They are utilized to account for the temperature gradient through the cook-top, i.e., the amount of heat that is lost or otherwise dissipated in the cook-top.

Once the cooking vessel temperature is calculated, it is compared to the desired temperature setting. If the calculated temperature is too low, the burner power is increased, and if the calculated temperature is too high, the burner power is reduced.

In order to maintain smooth and consistent control over the cooking vessel temperature, the temperature control system in some embodiments is designed to perform the foregoing steps and calculations at regularly spaced intervals. For example, the adjustment is performed every 10 seconds in some embodiments. Further, in some embodiments, a Proportional Integral (PI) equation based on the error of the desired temperature minus the computed cooking vessel temperature is used.

The temperature control functions of the stove are performed by the appropriate combination of data storage, memory, software, firmware, computer processors, and other hardware. Although the above description refers to use of the temperature control system in conjunction with a stove having at least one heating coil, the temperature control system is useful in stoves having any desired number of coils.

The temperature control system of the present invention is implemented in induction stoves having a wide variety of characteristics. It is simply a matter of calibrating the factors adjusted for by the stove to properly calculate the temperature in the cooking vessel. For example, the system is useful when a cooking vessel is placed directly on a cook-top. Similarly, the system can be calibrated for use when a cooking vessel is placed on a protective mat, which has been placed on top of the cook-top. In some embodiments, such a mat has a thermally transmissive portion for better transmitting heat from the cooking vessel to the temperature sensor, as described below.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A system for operation of an induction stove, comprising:

an AC to DC voltage converter receiving AC voltage from a power input and generating a DC voltage;

a filter having an input coupled to an output of said AC to DC voltage converter, said filter receiving and smoothing the generated DC voltage;

a voltage sensing unit coupled to an output of said filter, said voltage sensing unit receiving the smoothed DC voltage and including an optocoupler;

a processor coupled to the voltage sensing unit for receiving voltage information from said voltage sensing unit and controlling at least one of an input voltage, an input current, and an oscillation frequency of at least one heating coil of the induction stove based at least in part on said voltage information;

a heating coil, a cook-top having an upper surface adapted to receive a cooking vessel thereon, and a mat positioned on the upper surface of said cook-top, said mat having a lower side adapted to be in contact with the upper surface of said cook-top and an upper side adapted to have a cooking vessel placed thereon, said mat having a thermally insulating portion and a thermally transmissive portion;

said thermally transmissive portion overlaying a portion of the upper surface of said cook-top beneath which said heating coil is positioned;

said thermally insulating portion comprising a first portion and a second portion, the first portion overlaying a portion of the upper surface of said cook-top beneath which said heating coil is positioned, and the second portion overlaying a portion of the upper surface of said cook-top not associated with said heating coil;

said first portion of lower side having a first pattern formed therein and said second portion of the lower side having a second pattern formed therein, where the first pattern is different than the second pattern.

2. The system according to claim 1, wherein said voltage converter is a bridge rectifier.

3. The system according to claim 1, wherein said voltage sensing unit further comprises at least one voltage divider coupled to said voltage converter for dividing the voltage received from said filter.

4. The system according to claim 3, wherein said at least one voltage divider includes at least two resistors.

5. The system according to claim 1, wherein said voltage sensing unit further comprises a voltage to current converter coupled to said optocoupler, said converter receiving an input voltage and transmitting an output current to said optocoupler, wherein the input voltage and the output current have a linear relationship.

6. The system according to claim 1, wherein said voltage sensing unit further comprises a current to voltage converter coupled to said optocoupler, said converter receiving an input current from said optocoupler and transmitting an output voltage, wherein the input current and the output voltage have a linear relationship.

7. The system according to claim 1, further comprising a user input device that receives a power level selection from a user and transmits it to said processor.

8. The system according to claim 7, wherein said processor controls the at least one of the input voltage, the input current and the oscillation frequency of the at least one heating coil of the induction stove based at least in part on the power level selection from the user.

9. The system according to claim 7, wherein said processor comprises:

a software for calculating an initial drive voltage for the at least one heating coil based at least in part on the voltage information received from the voltage sensing unit at a selected power level;

a software for calculating an initial input current to the at least one heating coil to achieve the selected power level;

a software for calculating a drive frequency of the at least one heating coil for the selected power level; and a software for adjusting at least one of the input voltage, the input current and the oscillation frequency based at least in part on a coil current measured by at least one sensor that measures a current in the coil.

10. The system according to claim 1, wherein the optocoupler comprises at least one LED and at least one photodiode.

11. The induction stove according to claim 1, wherein said heating coil is an induction coil.

12. The induction stove according to claim 1 wherein the first pattern comprises square protrusions.

13. The induction stove according to claim 1 wherein the second pattern comprises wave-shaped protrusions.

14. The induction stove according to claim 1 wherein said thermally transmissive portion comprises aluminum and said thermally insulating portion comprises silicon.

15. An induction stove, comprising:

a heating coil;

an AC to DC voltage converter receiving AC voltage from a power input and generating a DC voltage;

a filter having an input coupled to an output of said AC to DC voltage converter, said filter receiving and smoothing the generated DC voltage;

a voltage sensing unit coupled to an output of said filter and including an optocoupler, said voltage sensing unit receiving the smoothed DC voltage from said filter; and a processor including software and receiving voltage information from the voltage sensing unit and controlling at least one of an input voltage, an input current, and an oscillation frequency of the heating coil with the software based on the voltage information;

a cook-top having an upper surface adapted to receive a cooking vessel thereon, and a mat positioned on the upper surface of said cook-top, said mat having a lower side adapted to be in contact with the upper surface of said cook-top and an upper side adapted to have a cooking vessel placed thereon, said mat having a thermally insulating portion and a thermally transmissive portion;

said thermally transmissive portion overlaying a portion of the upper surface of said cook-top beneath which said heating coil is positioned;

said thermally insulating portion comprising a first portion and a second portion, the first portion overlaying a portion of the upper surface of said cook-top beneath which said heating coil is positioned, and the second portion overlaying a portion of the upper surface of said cook-top not associated with said heating coil;

said first portion of lower side having a first pattern formed therein and said second portion of the lower side having a second pattern formed therein, where the first pattern is different than the second pattern.

16. The induction stove according to claim 15, wherein said voltage sensing unit further comprises at least one voltage divider coupled to said voltage converter for dividing the voltage received from said filter.

17. The induction stove according to claim 15, wherein said voltage sensing unit further comprises a voltage to current converter coupled to said optocoupler, said converter receiving an input voltage and transmitting an output current to said optocoupler, wherein the input voltage and the output current have a linear relationship.

18. The induction stove according to claim 15, wherein said voltage sensing unit further comprises a current to voltage converter coupled to said optocoupler, said converter receiving an input current from said optocoupler and transmitting an output voltage, wherein the input current and the output voltage have a linear relationship.

19. The induction stove according to claim 15, further comprising a user input device that receives a power level selection from a user and transmits it to said processor.

20. The induction stove according to claim 19, wherein said processor controls the at least one of the input voltage, the input current and the oscillation frequency of the at least one heating coil of the induction stove based at least in part on the power level selection from the user.

21. The induction stove according to claim 15, wherein the software of said processor comprises:

a software for calculating an initial drive voltage for the at least one heating coil based at least in part on the voltage information received from the voltage sensing unit at a selected power level;

a software for calculating an initial input current to the at least one heating coil to achieve the selected power level;

a software for calculating a drive frequency of the at least one heating coil for the selected power level; and a software for adjusting at least one of the input voltage, the input current and the oscillation frequency based at least in part on a coil current measured by at least one sensor that measures a current in the coil.

22. The induction stove according to claim 15, wherein said heating coil is an induction coil.

23. The induction stove according to claim 15 wherein the first pattern comprises square protrusions.

24. The induction stove according to claim 15 wherein the second pattern comprises wave-shaped protrusions.

25. The induction stove according to claim 15 wherein said thermally transmissive portion comprises aluminum and said thermally insulating portion comprises silicon.

* * * * *